US007469428B2

(12) United States Patent
Brauner et al.

(10) Patent No.: US 7,469,428 B2
(45) Date of Patent: Dec. 30, 2008

(54) RETRACTABLE HAT TETHER WITH BOTTLE OPENER DEVICE

(75) Inventors: Bill E. Brauner, Mountain View, CA (US); Brent W. Brauner, Mountain View, CA (US); Eivind Clausen, Bellingham, WA (US)

(73) Assignee: Streamworks, Inc., Stockton, CA (US)

( * ) Notice: Subject to any disclaimer, the term of this patent is extended or adjusted under 35 U.S.C. 154(b) by 0 days.

(21) Appl. No.: 11/638,316

(22) Filed: Dec. 12, 2006

(65) Prior Publication Data

US 2007/0163028 A1 Jul. 19, 2007

Related U.S. Application Data

(60) Provisional application No. 60/749,733, filed on Dec. 12, 2006.

(51) Int. Cl.
*A42B 1/00* (2006.01)

(52) U.S. Cl. ..... 2/171; 2/181.4; 2/182.2; 2/209.11; 2/209.13; 2/195.7

(58) Field of Classification Search ..... 2/171
See application file for complete search history.

(56) References Cited

U.S. PATENT DOCUMENTS

| | | | | |
|---|---|---|---|---|
| 701,639 | A | 6/1902 | Stamm | |
| 903,037 | A | 11/1908 | Westlund | |
| 938,281 | A | 10/1909 | Shaw | |
| 1,055,676 | A | 3/1913 | Soneshein | |
| 1,601,395 | A | 9/1926 | Ishiwata | |
| 2,051,594 | A * | 8/1936 | Dubin | 2/195.7 |
| 2,106,571 | A * | 1/1938 | Lipton | 2/171.5 |
| 2,686,917 | A | 8/1954 | Auerbach | |
| 4,263,679 | A | 4/1981 | Erlendson | |
| 4,276,657 | A | 7/1981 | Montesi | |
| D293,043 | S | 12/1987 | Zamboni | |
| 4,991,236 | A | 2/1991 | Pritchett | |
| 4,993,079 | A | 2/1991 | Johnson | |
| 5,092,472 | A | 3/1992 | Jones | |
| 5,144,695 | A | 9/1992 | Schweizer | |
| 5,514,016 | A | 5/1996 | Larson | |
| D371,006 | S | 6/1996 | Walker et al. | |
| 5,541,816 | A | 7/1996 | Miserendino | |

(Continued)

*Primary Examiner*—Gary L. Welch
*Assistant Examiner*—Alissa J Tompkins
(74) *Attorney, Agent, or Firm*—Weaver Austin Villeneuve & Sampson LLP

(57) ABSTRACT

A retractable hat tether apparatus for a hat having a cap portion is provided. The tether apparatus includes a guide base movably mounted to the cap portion for movement thereof along a fixed path between a first position and a second position. A flexible tether includes a first end and an opposite second end thereof mounted to the guide base. A bottle opener device is mounted to the first end, and is configured to function as a conventional bottle opener. The bottle opener device includes a clip member for releasable attachment to the cap portion. The bottle opener device is mounted to the first end such that, when the guide base moves along the fixed path between the first position and the second position, the tether and the bottle opener device move between a retracted condition, positioning the tether substantially along the fixed path, and an extended condition, positioning the tether at an exterior of the cap portion to enable the bottle opener device to be operated more freely since the useable tether is longer.

24 Claims, 15 Drawing Sheets

U.S. PATENT DOCUMENTS

| | | | | |
|---|---|---|---|---|
| 5,611,118 | A | 3/1997 | Bibbee | |
| 5,675,841 | A | 10/1997 | Jackson | |
| 5,890,638 | A | 4/1999 | Woloshen | |
| D412,611 | S | 8/1999 | Simpson | |
| 6,079,419 | A | 6/2000 | Perlsweig | |
| 6,154,887 | A | 12/2000 | Yagi | |
| 6,446,265 | B1 | 9/2002 | Moreau et al. | |
| 6,560,785 | B1 * | 5/2003 | Taguchi | 2/171.1 |
| 6,877,168 | B1 * | 4/2005 | Duffy et al. | 2/175.7 |

* cited by examiner

RETRACTABLE HAT TETHER WITH BOTTLE OPENER DEVICE

RELATED APPLICATION DATA

The present application claims priority under 35 U.S.C. §119 to U.S. Provisional Application Ser. No. 60/749,733, naming Brauner et al. inventors, filed Dec. 12, 2006, and entitled RETRACTABLE HAT TETHER WITH BOTTLE OPENER DEVICE, the entirety of which is incorporated herein by reference for all purposes.

FIELD OF THE INVENTION

The present invention relates to apparel tether devices, and more particularly, relates to retractable tether devices for hat wear apparel.

BACKGROUND OF THE INVENTION

Hat wear has historically been a prominent part of style and fashion. One particular style of hat apparel, visored caps, has recently become extremely popular for active outdoor wear and for casual wear. One particular problem associated with these caps, as well as with any visored headwear, is that they can unexpectedly dislodged from the head of the user under windy conditions or extreme physical activities. This event is particularly bothersome in circumstances where recovery of the hat may not be easily accomplished, such as during sporting activities (e.g., fly-fishing, snow skiing, jet skiing, etc.) or open-air traveling (e.g., motorcycle, convertibles, speed boating, etc.).

Numerous hat retaining devices have been developed to facilitate hat recovery in the previously mentioned conditions. Almost all hat retaining structure typically include a lengthy, flexible tether having a clip on one end, and some mounting structure coupling the other end to the hat or cap. One problem typically associated with these devices is that during non-use, the lengthy tether is unsupported and dangles or hangs freely. This free dangle can be quite unsightly, easily tangled or potentially hazardous to small children.

Attempts to retract the tether during non-use have been proposed in some tether devices. These assemblies, however, are either too complex, do not function adequately or significantly alter the footprint of the headwear. Accordingly, there is a need for a retractable hat tether device that eliminates the aforementioned problems.

SUMMARY OF THE INVENTION

The present invention provides a retractable hat tether apparatus for a hat having a cap portion. The tether apparatus includes a mounting assembly having a guide portion adapted to affix to the cap portion, and a guide base slideably mounted to the guide portion for movement thereof along a fixed path between a first position and a second position. The tether apparatus further includes a bottle opener device configured to function as a conventional bottle opener. The bottle opener device includes a clip member for releasable attachment to the cap portion. The bottle opener device is mounted to the first end such that, when the guide base moves along the fixed path between the first position and the second position, the tether and the bottle opener device move between a retracted condition, positioning the tether substantially along the fixed path, and an extended condition, positioning the tether at an exterior of the cap portion to enable the bottle opener device to be operated more freely since the useable tether is longer.

Accordingly, a useable bottle opener device is mounted to a tether, which in turn, is movably mounted to the hat, via the guide portion and the guide base of the mounting assembly. This enables the tether to extend from the hat for operation use of the bottle opener device. The tether can further to retract into the hat along the fixed path where the bottle opener device can be mounted to the hat and parked during periods of nonuse. This guided positioning effectively eliminates unsightly tether dangle through an efficient structure that reduces complexity and minimizes parts.

In one specific embodiment, the tether apparatus includes a parking structure that is mounted to the cap portion of the hat, and forms a parking receptacle sized for receipt of the bottle opener device therein. During periods of nonuse, the bottle opener can be stored and secured. A clip member is also included to facilitate mounting of the opener device to the parking sleeve.

In one specific embodiment, the guide portion cooperates with the cap portion of the hat to form an elongated pocket along the fixed path upon which a substantial portion of the tether retracts into the pocket in the retracted condition, when the guide base is moved to the first position. The length of the tether is, therefore, similar to the length of travel of the guide base along the fixed path between the first position and the second position.

In another configuration, the guide portion extends substantially through a crown of the cap portion from a frontside of the cap portion to a rearside of the cap portion. The guide base may be adapted to glide along the guide portion in railing type manner. For example, in one arrangement, the mounting assembly is provided in the form of a zipper mechanism.

In one specific configuration, the functional element is comprised of one of a bottle opener, a flashlight or a retaining mechanism.

In yet another aspect of the present invention, a headwear assembly is provided that includes a headwear device having a cap portion. A bottom edge portion of the cap portion is configured to extend around a forehead of a user in a manner retaining the headwear to the user's head. A mounting assembly includes an elongated guide portion coupled to the cap portion, and extends generally longitudinally along and substantially adjacent to the bottom edge portion of the cap portion. A guide base movably cooperates with the guide portion for movement thereof along a fixed path substantially parallel to the bottom edge portion between a first position and a second position. The headwear assembly further includes a functional device providing a function; and an elongated flexible tether having one portion thereof mounted to the functional device, and another portion thereof mounted to the guide base. When the guide base moves along the fixed path between the first position and the second position, the tether and the functional device move between a retracted condition and an extended condition, enabling freer operation of the functional device.

In one specific embodiment, the cap portion of the headwear device includes an elongated crown portion that defines the bottom edge portion. A rear facing wall of the crown portion supports the guide portion thereon. The guide portion cooperates with the rear facing wall to form an elongated pocket upon which a substantial portion of the tether retracts in the retracted condition.

In another configuration, the headwear device includes an elongated protective headband portion disposed substantially adjacent and parallel to at least the bottom edge portion of the crown portion. The mounting assembly is disposed between the rear facing wall of the crown portion and the protective headband portion to protect and isolate a user from contact with the mounting assembly. The headband portion is secured to the crown portion of the cap portion in a manner enabling movement of the headband portion, relative to the crown rear facing wall, between a closed condition and an opened condition. In the closed condition, access to the mounting assembly is prevented, while in the opened condition, access to the mounting assembly is permitted.

In still another specific arrangement, the crown portion defines a parking receptacle formed and dimensioned for sliding receipt of the functional device therein. The parking receptacle is disposed substantially adjacent the access aperture.

In yet another embodiment, the headwear device is comprised of a visor-style headwear.

BRIEF DESCRIPTION OF THE DRAWINGS

The assembly of the present invention has other objects and features of advantage which will be more readily apparent from the following description of the best mode of carrying out the invention and the appended claims, when taken in conjunction with the accompanying drawing, in which:

DETAILED DESCRIPTION OF THE INVENTION

Figure 1:
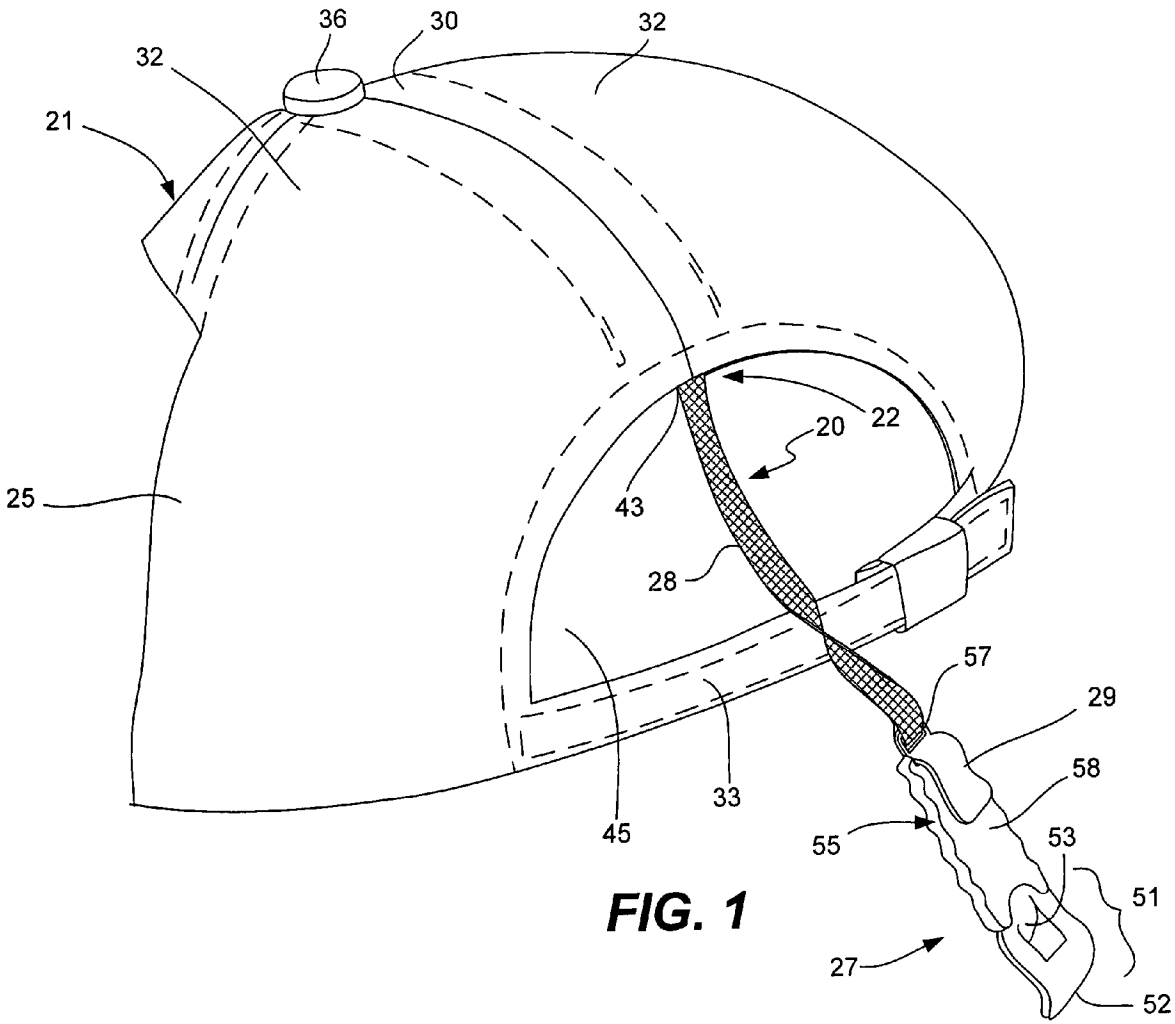
FIG. 1 is a fragmentary, top rear perspective view of a sports cap incorporating a retractable tether apparatus and the bottle opener device constructed in accordance with the present invention, illustrated in an extended position.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 2:
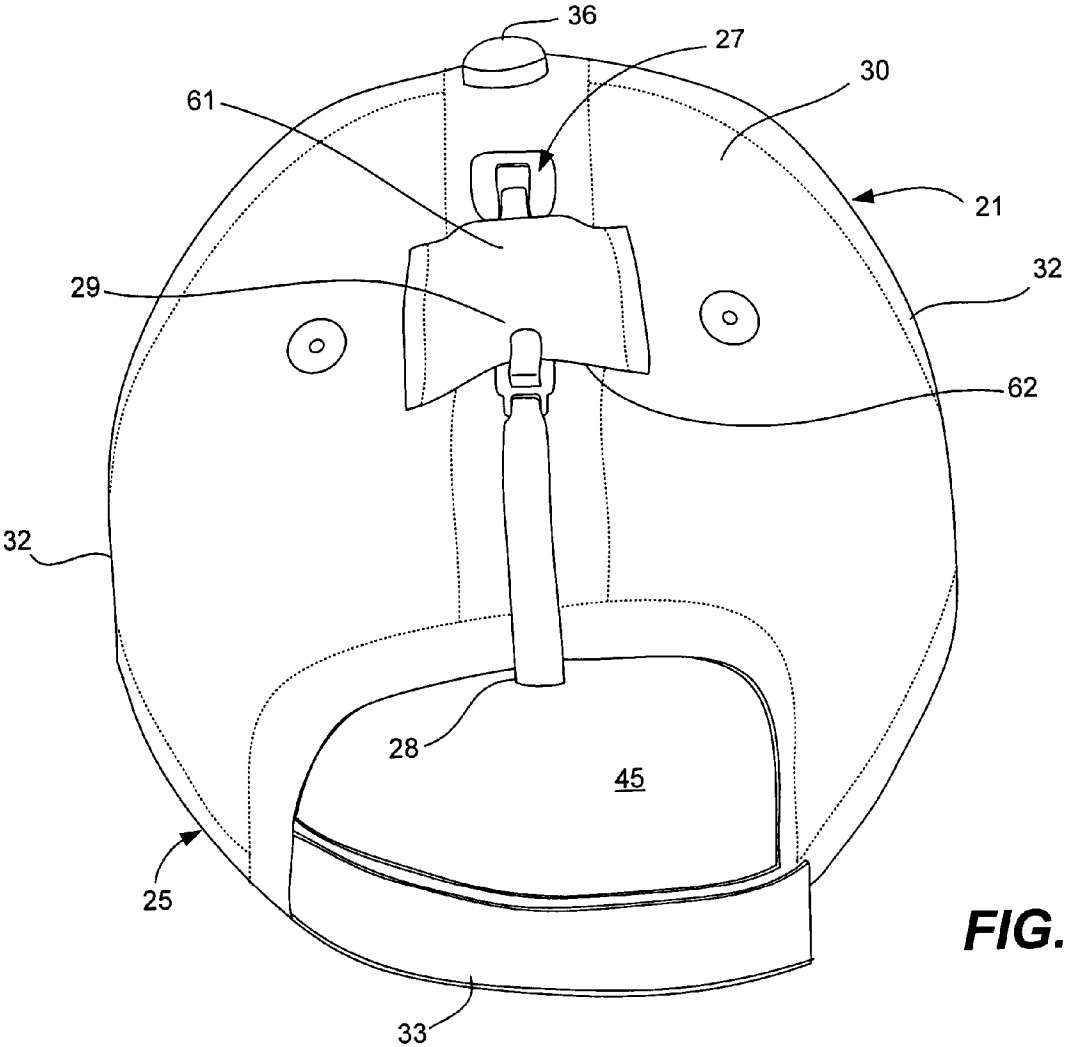
FIG. 2 is a top rear perspective view of the sports cap and retractable tether apparatus of FIG. 1, in a retracted position, and illustrating the bottle opener device secured to the sports cap.
Figure 3:
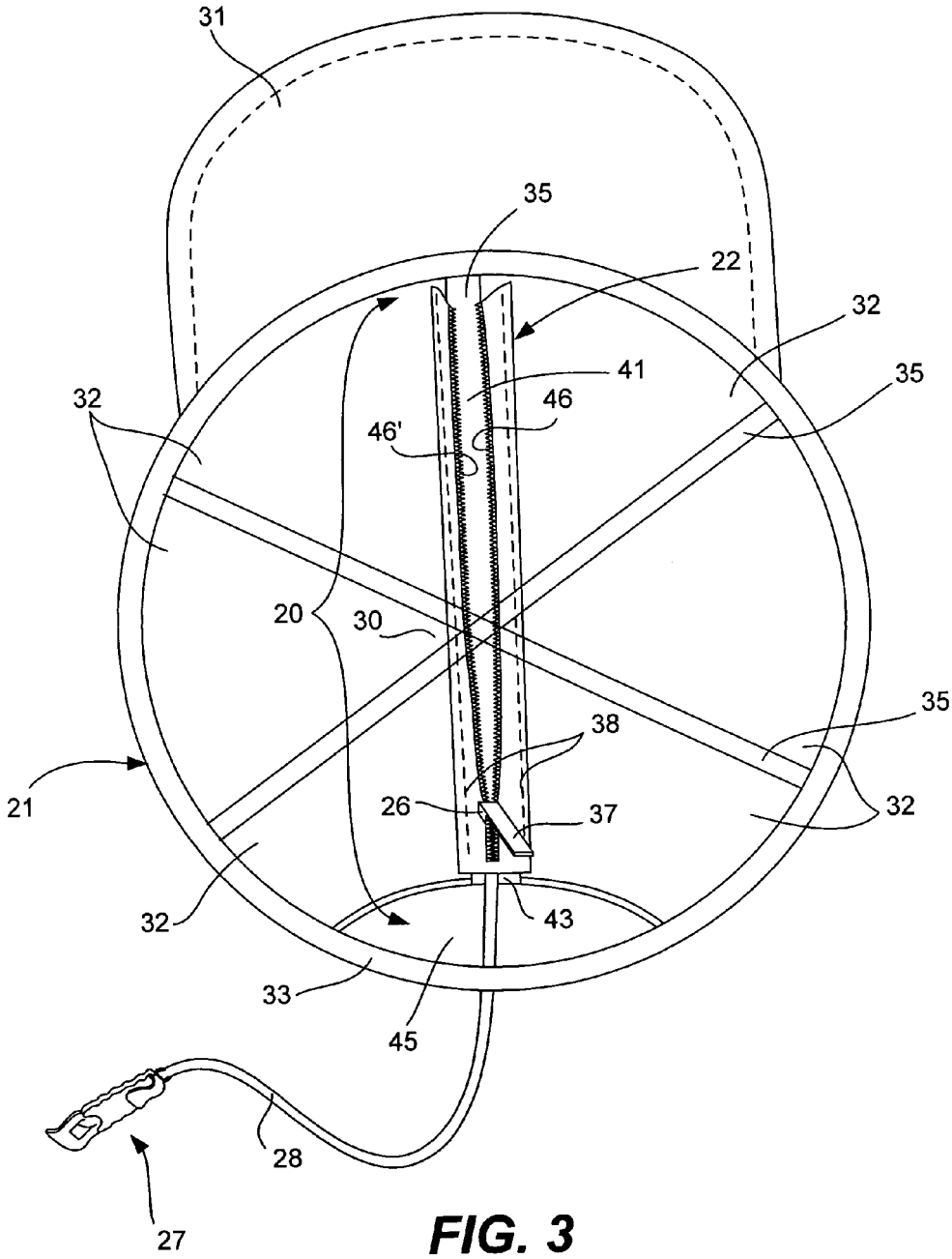
FIG. 3 is a bottom plan view of the sports cap and retractable tether apparatus of FIG. 1, in the extended position.
Figure 4:
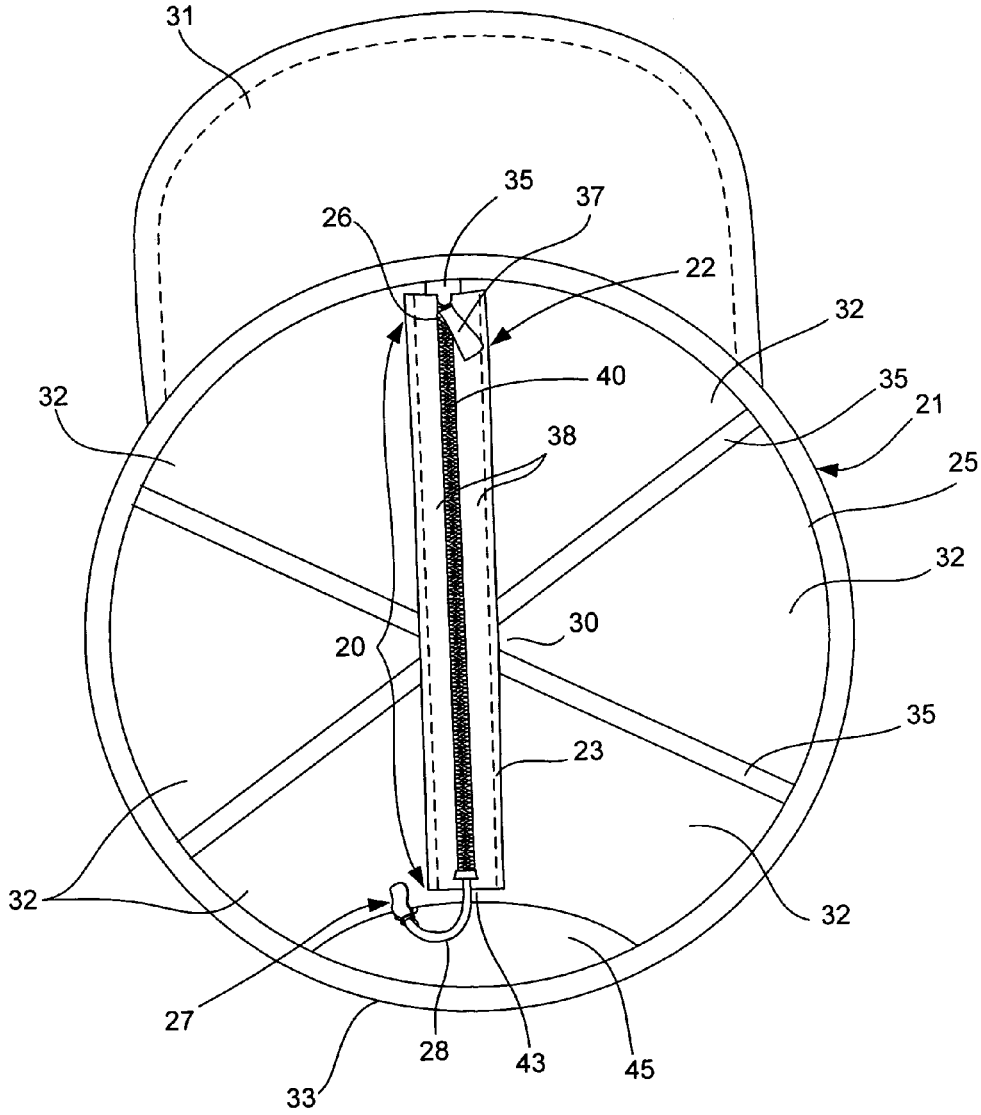
FIG. 4 is a bottom plan view of the sports cap and retractable tether apparatus of FIG. 1, in the retracted position.
Figure 5:
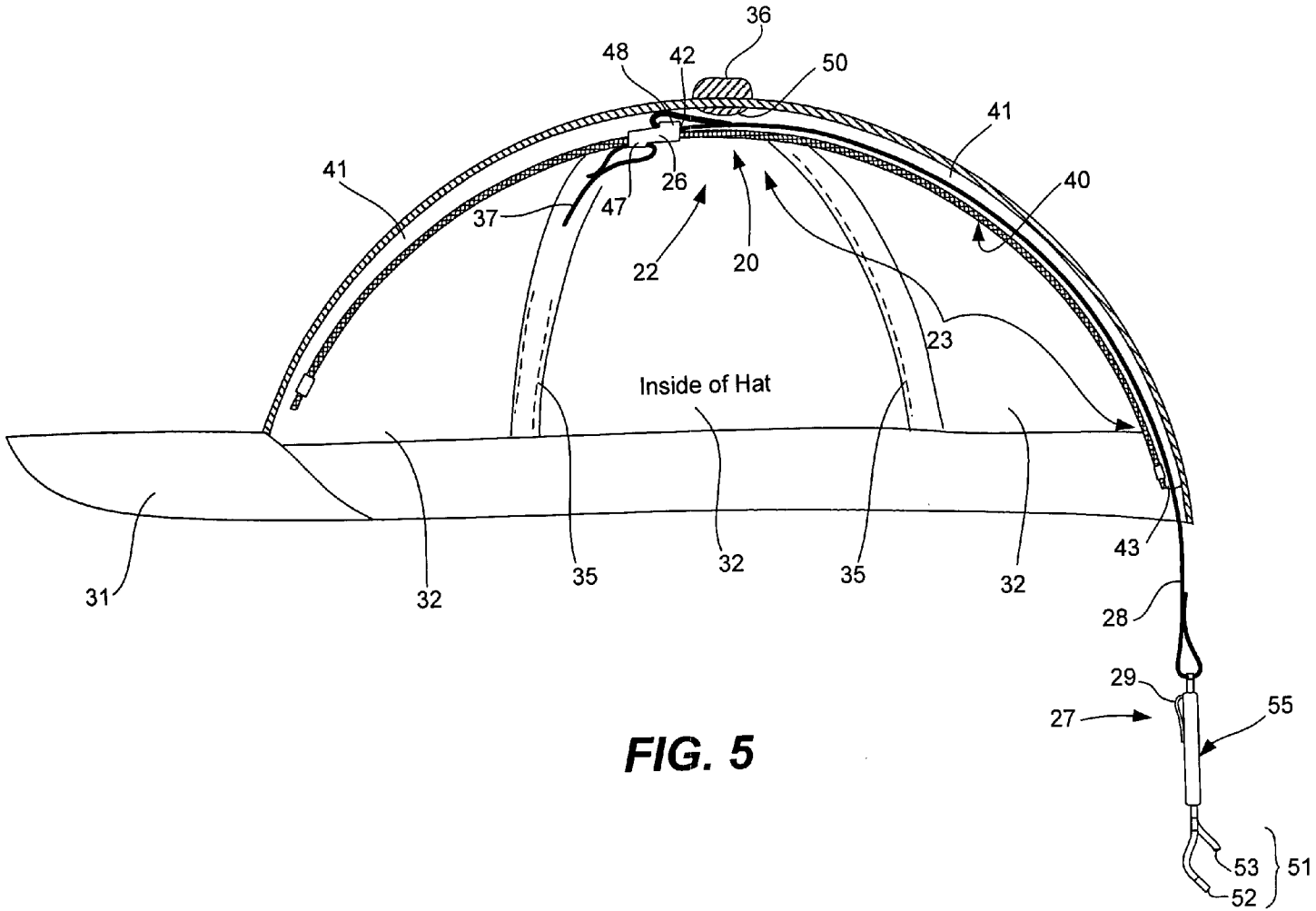
FIG. 5 is an enlarged, side elevation view, in cross section, of the sports cap and retractable tether apparatus of FIG. 4

Referring now to FIGS. 1-4, a headgear or hat assembly, generally designated 21, is provided having a retractable hat tether apparatus, generally designated 20. The tether apparatus 20 includes a mounting assembly, generally designated 22, having a guide portion 23 adapted to affix to the cap portion 25. The mounting assembly 22 further includes a guide base 26 movably mounted to the guide portion for movement thereof along a fixed path between a first position (FIG. 3) and a second position (FIGS. 4 and 5). The tether apparatus 20 further includes functional device 27, such as a conventional bottle opener device. A flexible tether 28 is provided having one portion of the tether 28 mounted to the functional device 27, while another portion of the tether is mounted to the guide portion. The hat assembly 21 defines a parking receptacle 62 formed and dimensioned for sliding receipt of the functional device therein. The tether apparatus 20 is structured such that when the guide base 26 moves along the fixed path between the first position and the second position, the one portion of the tether and the functional device move between an extended condition (FIGS. 1 and 3) and a retracted condition (FIGS. 2, 4 and 5), respectively. In the retracted condition, the guide base 26 and the tether 28 cooperate to position the tether along the fixed path, and further orient the functional device 27 proximate to the parking receptacle 62 for sliding receipt therein during periods of nonuse. In the extended condition, in contrast, the tether is extended from the hat to enable the functional device 27 to be operated more freely since the useable tether is longer.

Accordingly, in one example, the functional element is a useable bottle opener device mounted to the tether, which in turn, is movably mounted to the hat, via the guide portion and the guide base of the mounting assembly. This enables the tether to extend from the hat for operation use of the bottle opener device. The tether can further retract into the hat along the fixed path where the bottle opener device can be mounted to the hat and parked within the parking receptacle during periods of nonuse. Further, as shown in FIGS. 2 and 4, in this position, the tether does not freely hang or dangle about the hat to prevent entanglement. A much more organized and cleaner appearance is provided as compared to most current headwear tether devices.

It will be appreciated that the present invention can be utilized with any headwear device without departing from the true spirit and nature of the present invention. For example, as shown in FIGS. 11-20, the tether apparatus is integrated into the crown portion 30 of a visor-style headgear 21. The present invention, however, is initially illustrated and incorporated into one specific style of headwear (i.e., a conventional sports cap). Typically, these sports caps 21 include a crown portion 30 adapted to fit a wearer's head. This portion is generally fabricated by sewing together six material clothe pieces 32 each cut to have substantially a triangle shape. As in the case of a conventional cap, a sunshade or visor 31 is mounted to a front lower edge section of the crown portion 30 of the cap portion 25. Further, a size-adjusting device 33 is mounted to a rear lower edge section of the crown for adjusting the size of the cap. This is typically provided by an elastic band, a belt or opposed non-elastic bands with a VELCRO®-type or snap-type fastener.

To reinforce the seams of the crown portion 30, three tapes 35 are often stitched along the seams of the material cloth pieces 32 to cross a top button 36 mounted at the central portion of the crown portion 30 in the front to back direction and in the right and left diagonal directions. Not only do these tapes 35 reinforce the seams, but also serve to maintain the shape of the crown portion 30.

In one specific embodiment of the present invention, the mounting assembly 22 integrates smoothly within one of the reinforcement tapes strips. In this manner, the appearance is minimally altered from conventional cap structures, although such integration is not necessary for performance of the tether apparatus 20. More particularly, as best shown in FIGS. 3-5, the guide portion 23 of the mounting assembly extends about the crown portion 30 from a backside of the cap portion 25 to a front side thereof, defining the fixed path along the crown portion. Since the mounting assembly is preferably mounted to an interior side of the cap portion 25, as opposed to an exterior side thereof, the retraction of the tether dangle during hat use will be even more apparent. Exterior mounting of the tether apparatus, however, is an option.

Figure 6:
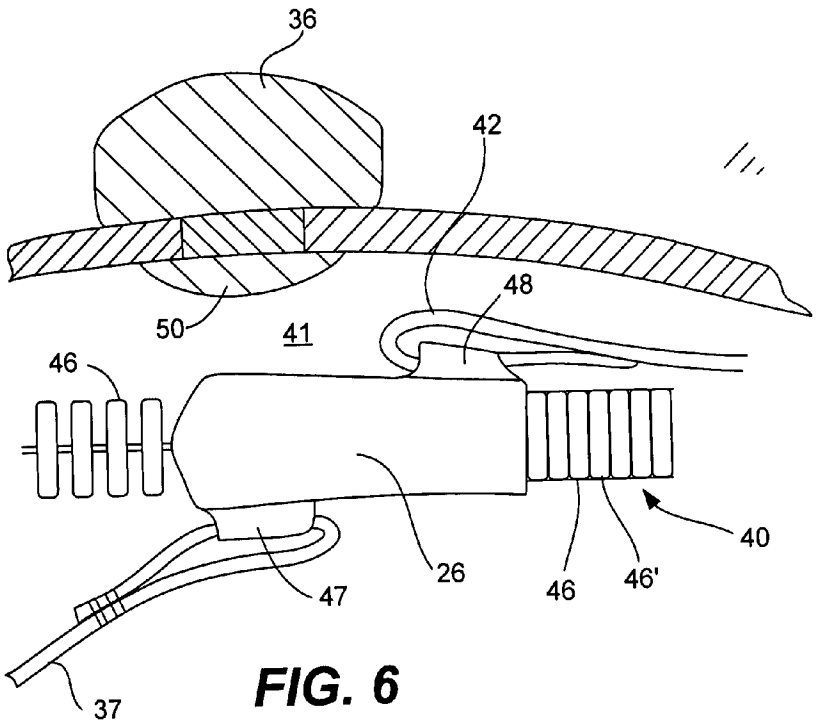
FIG. 6 is an enlarged, fragmentary, side elevation view, in cross section, of a guide track and guide base of the retractable tether apparatus of FIG. 5.

A pull tab 37 is included that is mounted to the guide base 26 of the mounting assembly 22 to facilitate manual manipulation thereof between the first position and the second position. Moreover, as best illustrated in FIGS. 5 and 6, the first end 42 of the tether 28 is mounted to the guide base 26, as well. Accordingly, as the guide base 26 is manually moved or pulled along the guide portion 23 of the mounting assembly between the first and second positions, the flexible tether 28 is drawn along the fixed path. In turn, the bottle opener device 27 moves between the extended (FIGS. 1 and 3) and retracted conditions (FIGS. 2, 4 and 5), respectively.

The tether 28 is preferably composed of a relatively flexible non-elastic material that provides sufficient tensile strength. Such flexibility is required to permit mounting of the bottle opener device 27 to the user's apparel, when oriented in the extended condition, while being capable of conforming to the profile of the cap portion 25, along the fixed path, when the tether 28 is moved to the retracted condition. Many cord or strap materials can be satisfactorily employed such as rope, twine, plastic, nylon, and other fabrics. One specific example of the tether material is a tether ribbon composed of fabric. While a non-elastic tether material is preferred, an elastic material can be employed, however.

Turning now to FIGS. 2 and 3, the guide portion 23 includes a guide support 38 that supports a guide track 40 upon which the guide base 26 is movably mounted. The guide support 38 is comprised of an elongated, rectangular material having sufficient flexibility to conform to the curvature or profile of the cap portion 25 of the hat. The guide track 40, similarly is composed of a material sufficiently flexible to enable conformance of the guide track to the curvature or profile of the cap portion 25, yet provide sufficient rigidity and support to enable the guide base 26 to move, slide and/or track therealong. Such materials include virtually any type of fabric.

To accommodate and retain the flexible tether along the fixed path, the guide portion 23 cooperates with the cap portion 25 to form an elongated pocket 41 extending substantially along the fixed path between the first position and the second position. This pocket 41, as best viewed in FIGS. 3-5, is sized and dimensioned to slideably receive into and deliver therefrom the tether 28, mounted at the first end 42 to the guide base 26, as the guide base reciprocates along the guide track 40.

The elongated pocket 41 is created along the fixed path by fastening the opposed longitudinal edge portions of the rectangular guide support 38 to the cap portion 25. As indicated, the opposed edges of the guide portion are affixed to the corresponding edges of one cloth piece 32 of the cap. At one end of the pocket is an opening 43 into the pocket 41 that is formed to receive into and deliver therefrom the tether as the guide base moved along the guide track 40. This pocket opening 43 is preferably positioned at the distal end of the pocket 41, delivering the tether into a bay portion 45 of the cap portion formed between a rear peripheral edge thereof and the size adjusting device 33 of the hat.

Accordingly, as the guide base 26 is manually moved, via pull tab 37, along fixed path of the guide track from the second position, where the tether 28 is in the corresponding retracted condition (FIGS. 2, 4 and 5), to the first position, where the tether is in the corresponding extended condition (FIGS. 1 and 3), the tether is delivered from storage in the pocket 41 through the pocket opening 43. Another technique to deliver the tether is by simply pulling on the bottle opener device 27, which in turn draws the tether through the pocket opening 43 to the retracted condition, and displaces the guide base 26 from the first position to the second positions. This provides a sufficient extension of length of the tether ribbon to enable freer operation of the bottle opener device 27 by the user.

During periods of non-use, the tether 28 can be retracted back into the pocket 41 through the pocket opening 43. This is performed by manually manipulating the guide base 26, via pull tab 37. By pulling the guide base along the guide track from the first position (FIGS. 1 and 3) to the second position (FIGS. 2, 4 and 5), the tether 28 which is attached to the guide base 26 at the one end, is pulled and retracted back through the pocket opening 43 and along the fixed path of the pocket 41 toward the retracted condition.

It will be understood that the extension length of the tether 28 can be controlled by the length of the fixed path for the first position to the second position. For example, should the guide portion 23 of the mounting assembly only extend from the top of the crown portion 30 to the bay portion 45 of the cap 21, the extension length of the tether 28 from the retracted condition to the extended condition will be proportionately shortened. Thus, depending upon the application, the tether extension can be adjusted accordingly.

In accordance with the present invention, as the head or guide base 26 of the mounting assembly moves, slides and/or ratchets along the guide portion 23, the tether is retained along the fixed path, substantially eliminating tether dangle. The guide portion, in one specific embodiment, is provided by a rail-type structure that cooperates with the guide base 26 to move both the guide base and the one end of the tether along the fixed path. In one example, a ratchet type structure maybe provided that locks the guide base along the fixed path between the first position and the second position unless the guide base, and hence the tether, is released. Other sliding-type devices suitable for use along the guided fixed path include plastic zippers, and enclosed glide and pull devices.

More specifically, the example illustrated in FIGS. 2, 3 and 5 represent a conventional zipper style mechanism as the mounting assembly. The guide track 40, thus, is provided by the zipper teeth or chain portion of a zipper, while the guide base 26 is provided by a zipper slider. Thus, when the zipper slider slides or tracks along the zipper teeth 46, 46' between the first position (FIGS. 1 and 3) and the second position (FIGS. 2, 4 and 5), the tether ribbon 28 is moved between the extended condition and the retracted conditions, respectively.

The pull tab 37 or the like is included mounted to a lower bracket 47 of the zipper slider for manual manipulation of the zipper between the first position and the second position. Similarly, the first end 42 of the tether ribbon 28 is mounted to an upper bracket 48 of the zipper slider. As best viewed in FIGS. 5 and 6, the first end of the tether ribbon 28 extends over the upper bracket 48. This is advantageous in that the tether ribbon functions as a ramp portion to facilitate unobstructed passage of the zipper upper bracket 48 past the rivet 50 of the cap button 36 of hat 21.

In this particular sample, when the guide base 26 (e.g., zipper slider) is moved to the first position, retracting the tether into the pocket 41, the zipper mechanism is zipped or closed. In contrast, when the zipper slider is moved to the second position, delivering the tether from the pocket 41, the zipper mechanism is unzipped or opened.

Referring now to FIGS. 1 and 7-10, the bottle opener device 27 is described in greater detail. This bottle opener device 27 is substantially conventional in shape and function. At one end of the opener device 27 is a conventional bottle opener structure 51 including a contacting portion 52 and a gripping portion 53 spaced from the contacting component. At the opposite end of the opener device 27 is a handle portion 55. The contacting portion 52 is provided to contact the top of the conventional bottle top (not shown), while the gripping portion 53 is applied to grip the lower peripheral edge of the bottle top. As is conventional, applying the two components properly via the handle portion 55, the bottle opener device 27 can be easily manipulated to remove a bottle cap from a bottle.

It will be appreciated that while the bottle opener structure 51 is shown in only one configuration, any conventional bottle opener structure can be fitted to the handle portion 55.

Figure 7:
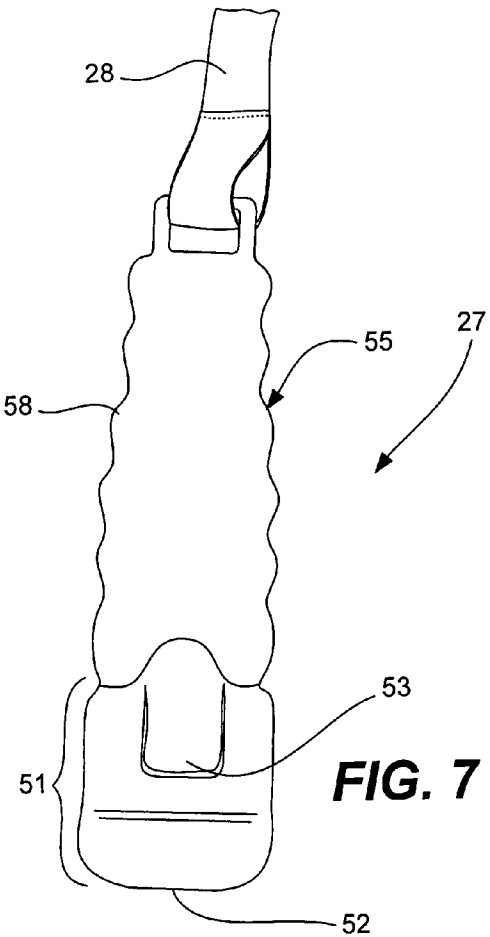
FIG. 7 is an enlarged, top plan view of the bottle opener device mounted to the retractable tether apparatus of FIG. 1.
Figure 8:
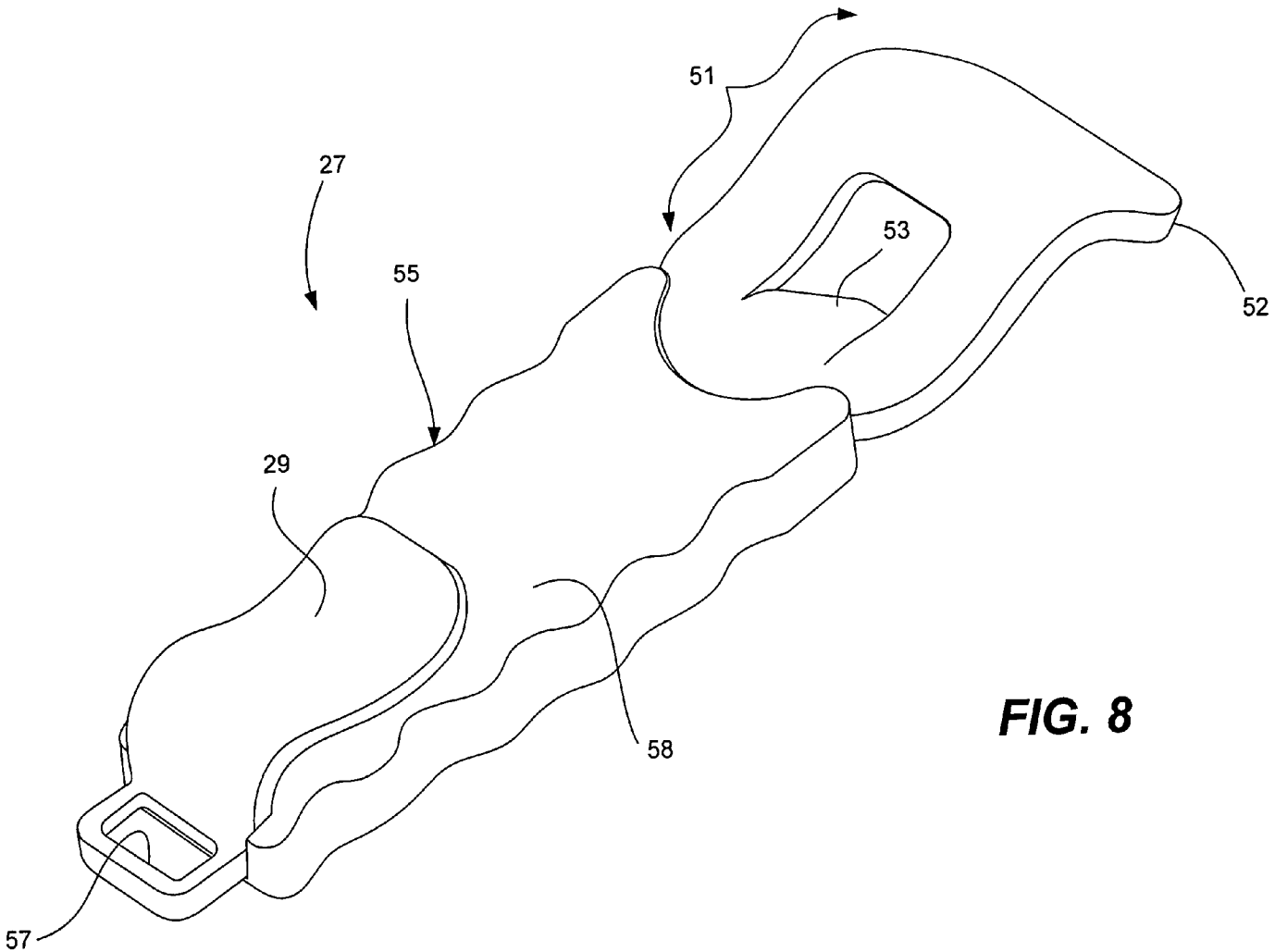
FIG. 8 is an enlarged top perspective view of the bottle opener device of FIG. 1.
Figure 9:
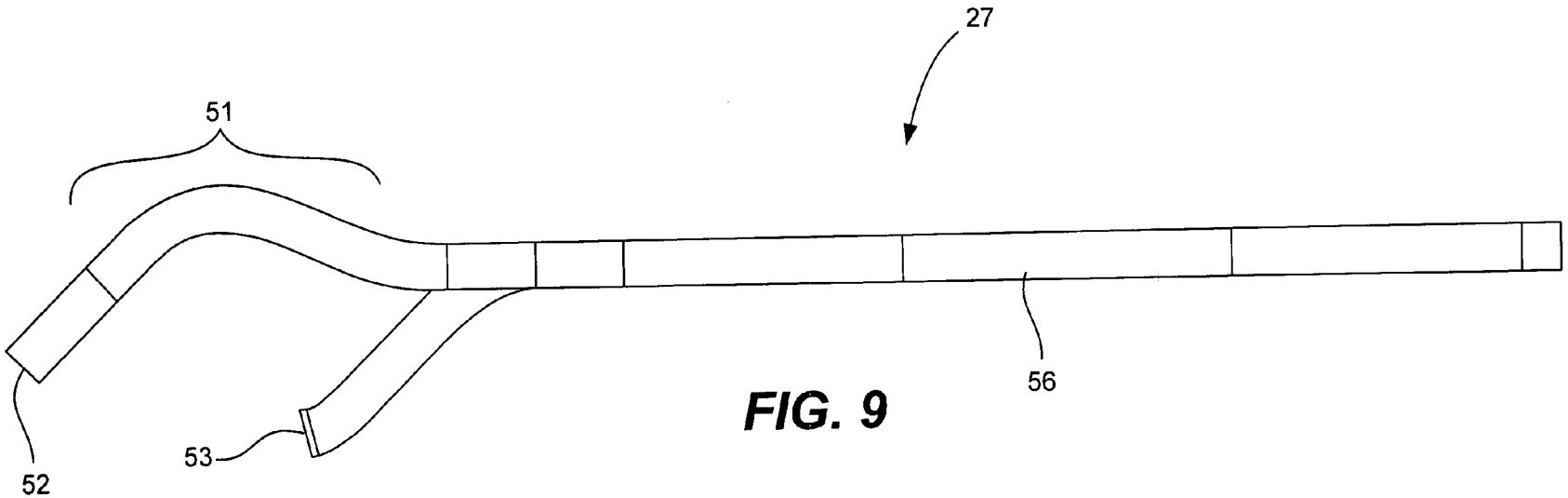
FIG. 9 is a side elevation view of the bottle opener device of FIG. 8.
Figure 10:
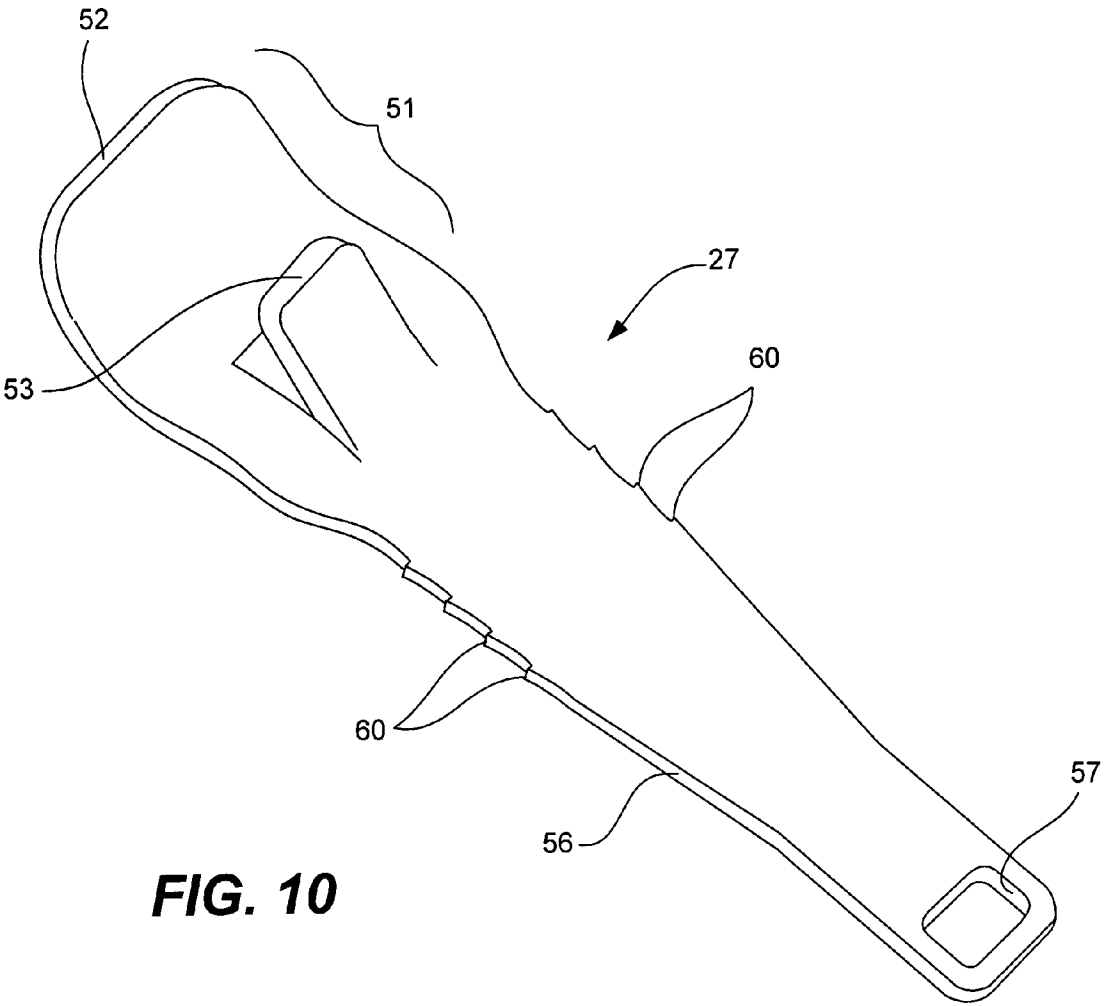
FIG. 10 is a bottom perspective view of the bottle opener device of FIG. 8.

As best shown in FIG. 1, 2 and 7, the distal end of the tether 28 is connected to a distal end of the handle portion 55. In one embodiment, the handle portion 55 is preferably composed of a support arm 56 having a proximal end that couples to the tether 28 and a distal end that is integral with the bottle opener structure 51. The proximal end of the support arm 56 includes a tether aperture 57 sized for receipt of the tether 28 there through for mounting to the distal end of the tether (FIGS. 8 and 10). The handle portion may further include a gripping cover 58 disposed around the support arm 56 to provide comfort and gripping to the user. This gripping cover 58 may be composed of a molded composition such as TPE, polypropylene. To facilitate mounting of the gripping cover 58 to the support arm 56, barbs or tines 60 are included to prevent the cover from moving relative to the support arm 56 (FIG. 10).

In one specific configuration, FIG. 2 illustrates that the bottle opener device 27 may be secured to the exterior of the cap portion 25. Thus, during periods of non-use, the opener device 27 can be secured to the cap and not dangle freely as well. To facilitate securing to the cap portion, a parking structure 61 is mounted to the cap portion 25 that forms the parking receptacle 62 with the cap portion 25 for receipt and parking of the opener device 27 therein. The parking structure, by way of example, includes a thin material body having opposed ends affixed to the exterior of the cap portion 25. The parking receptacle 62, in one embodiment, is sized and dimensioned for friction fit of the opener device 27 therein.

In another embodiment, the handle portion 55 may include a clip member 29 capable of secured, releasable attachment to the parking structure 61. Such a clip member is particularly important when the functional device is a relatively heavier element such as the bottle opener or a flashlight device. The clip member 29 is resiliently mounted to the gripping cover 58 at the proximal end of the handle portion 55, and extends distally. Hence, during receipt of the opener device in the parking receptacle 62 of the parking sleeve, the opener device 27 can be secured to the cap portion 25 when the parking sleeve is received in the between the jaw of the clip member 29 and the gripping cover 58 (FIG. 2). It will be appreciated that other conventional clips or fasteners may be applied such as VELCRO® or the like.

In another aspect of the present invention, as best viewed in FIG. 11-20, the tether apparatus 20 is mounted along the bottom edge 63 of the cap portion 25 that is mounted to the sunshade/visor 31 of the headwear. Preferably, the guide portion 23 is oriented substantially parallel and adjacent to the bottom edge 63 of the cap portion. In this manner, the guide base 26, which is movably mounted to the guide portion, moves along the fixed path between the extended first position (FIGS. 14, 16,18 and 20) and the retracted second position (FIGS. 13, 15, 17 and 19). Hence, the fixed path is also oriented substantially parallel and adjacent to the bottom edge 63 of the cap portion.

Figure 11:
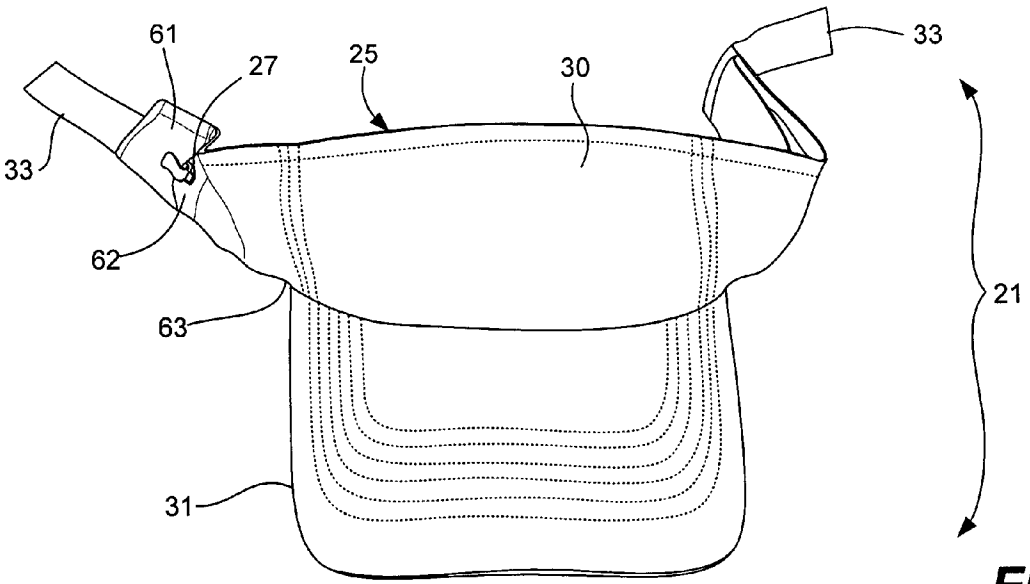
FIG. 11 is a top front perspective view of an alternative embodiment visor-style headwear with a retractable tether apparatus in accordance with the present invention.
Figure 12:
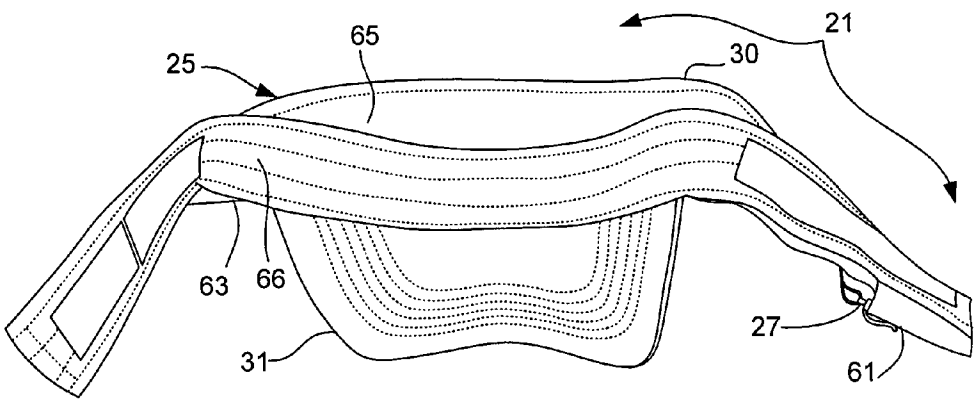
FIG. 12 is a top rear perspective view of the visor-style headwear of FIG. 11, illustrating a protective headband in the closed condition.

Accordingly, this design, while applicable to conventional baseball-style headwear, is particularly suitable for use in visor-style headwear. In conventional visor-style headwear, as shown in FIGS. 11 and 12, unlike the baseball-style headwear of FIGS. 1-5, the crown portion 30 of the cap portion 25 do not extend over and around the substantial scalp area of ones head, but more or less primarily extend around the front brow or forehead region.

In particular, the guide portion 23 of the tether apparatus 20 is oriented along an interior wall 65 of the crown portion 30 of the cap portion 25, between the crown portion and a headband portion 66 of the cap portion 25. Accordingly, the headband portion 66 not only functions as a means to secure the headwear to a user, but also functions as a protective cover or padding against the user's forehead or brow region from the guide base 26 and guide portion 23 during operational use.

The headband portion 66 may be composed of the same material comprising the crown portion of the visor-style headwear 21. In another embodiment, additional padding material may be fitted between the layers of the headband to increase its padding capabilities. Further, the protective headband may incorporate an elastomer or elastic material to improve universal fitment. Similar to the embodiments in FIGS. 1-5, a size-adjusting device 33 can be mounted to a rear lower edge section of the crown portion for adjusting the size of the cap. This is typically provided by an elastic band, a belt or opposed non-elastic bands with a VELCRO®-type or snap-type fastener.

Figure 15:
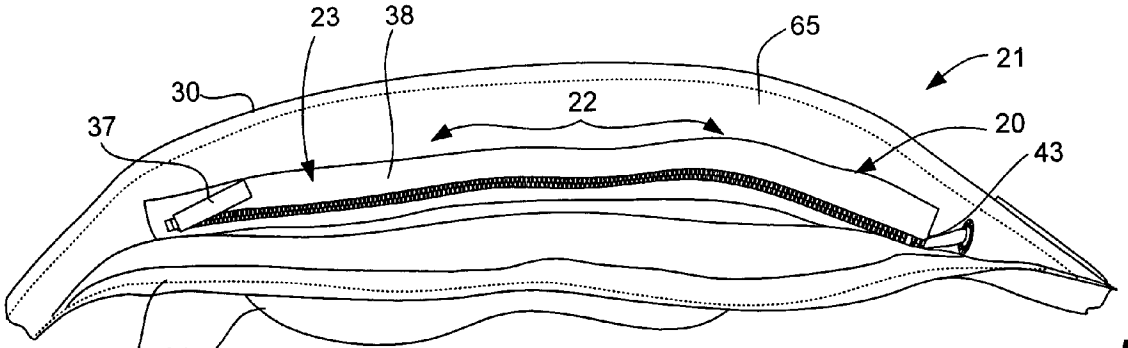
FIG. 15 is an enlarged, top rear perspective view of the visor-style headwear of FIG. 12, illustrating the protective headband in the opened condition with a guide base in the retracted second position.
Figure 16:
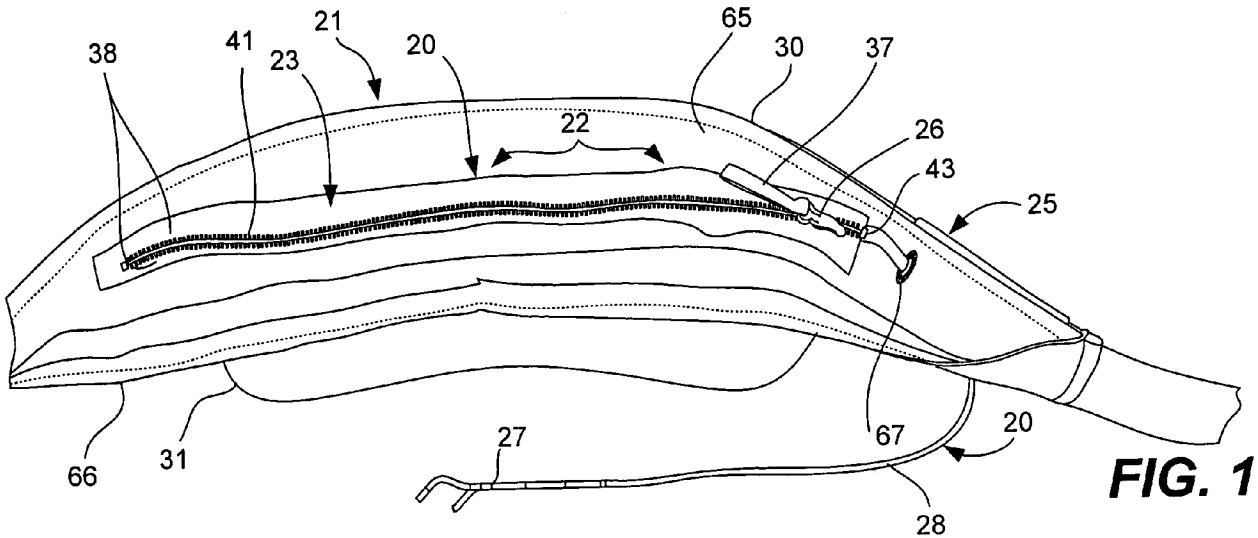
FIG. 16 is a top rear perspective view of the visor-style headwear of FIG. 15, illustrating the protective headband in the opened condition with a guide base in the extended first position.

Referring now to FIGS. 12, and 15-17, the headband portion 66 of the cap portion 25 is movable, relative to the crown portion 30, between a closed condition (FIGS. 12 and 17) and an opened condition (FIG. 15 and 16). In the closed condition, the protective headband portion 66 functions as a protective flap, extending over the guide base 26 and the guide portion 23. Hence, access to operation of the guide base 26 is impeded, and the user may utilize the headwear in a protective state. In contrast, in the opened condition (FIGS. 15, 16 and 18), access to the guide base is permitted to operate the guide base 26. For instance, the guide base 26 can be manually moved along the first path from the second position (FIG. 16) to the first position (FIG. 15), retracting the tether device 28 into the elongated pocket 41 of the mounting assembly 22 from the extended position to the retracted position.

Briefly, in the preferred form, a bottom edge of the headband portion 66 is secured to the bottom edge of the crown portion 30, effectively defining the bottom edge portion 63 of the cap portion 25. In this configuration, hence, access to the mounting assembly 21 is provided via access at the adjacent top edge portions between the crown portion and the headband portion. It will be appreciated, of course, that the adjacent top edge portions may be secured together, enabling access to the guide components through the adjacent edge bottom portions thereof. It will also be appreciated that the headband portion 66 and the adjacent crown portion 30 may also be secured together only at the opposed ends thereof, effectively enabling access to the guide components from either the adjacent top edge or bottom edge portions.

Referring back to FIGS. 15 and 16, it will be appreciated that the mounting assembly 22 of this specific embodiment is substantially similar to that of the embodiment illustrated in FIGS. 1-5. Briefly, the guide portion 23 of the tether apparatus includes a guide support 38 that supports a guide track 40 upon which the guide base 26 is movably mounted. The guide portion 23 is mounted to the rear facing wall 65 of the crown portion 30, and extends substantially parallel and adjacent to the bottom edge portion 63 of the cap portion, at an orientation just above where visor 31 is attached to the cap portion 25. In one specific configuration, the mounting assembly 22 is provided by a conventional zipper style mechanism.

To accommodate and retain the flexible tether along the fixed path, the guide portion 23 cooperates with the cap portion 25, at the crown portion 30, to form the elongated pocket 41 extending substantially along the fixed path between the first position and the second position. This pocket 41, similar to that of the embodiment of FIGS. 3-5 and as best viewed in FIG. 16, is sized and dimensioned to slideably receive therein, and deliver therefrom, the tether 28, which in turn is mounted to the guide base 26 at the first end 42.

The elongated pocket 41 is created along the fixed path by fastening the opposed longitudinal edge portions of the rectangular guide support 38 to the crown portion 30. As indicated, the opposed laterally edges of the guide portion are affixed to the rear facing or underside wall of the crown portion 30. At one distal end of the guide support 38 is an opening 43 into the pocket 41 that is formed to receive therein and deliver therefrom the tether 28 as the guide base 26 is moved along the guide track 40. An access aperture 67 (FIGS. 16 and 19) is positioned adjacent the pocket opening 43 that extends through the crown portion 30. Through this access aperture 67, the tether 28 can be delivered for operation and use. This access aperture 67 is preferably oriented proximate a distal portion of the crown portion 30 near the size adjusting device 33 and on the side of the headwear where the parking receptacle 62 resides. In one specific configuration, in fact, the access aperture 30 is disposed directly adjacent the parking receptacle 62 for parking of the functional device.

Figure 13:
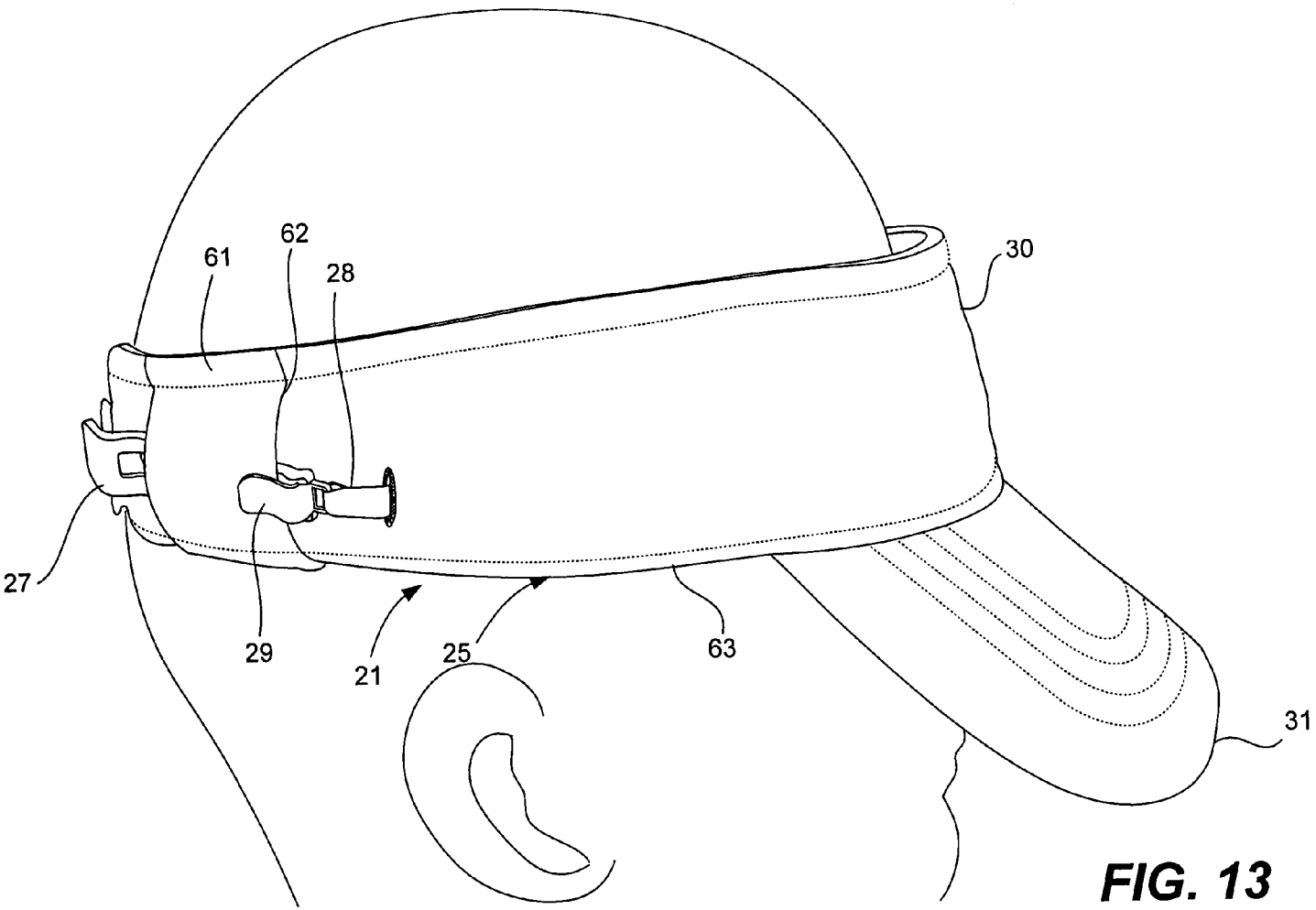
FIG. 13 is an enlarged, side elevation view of the visor-style headwear of FIG. 11, illustrating a can opener, as the functional device, secured in a parking receptacle for storage during nonuse.
Figure 14:
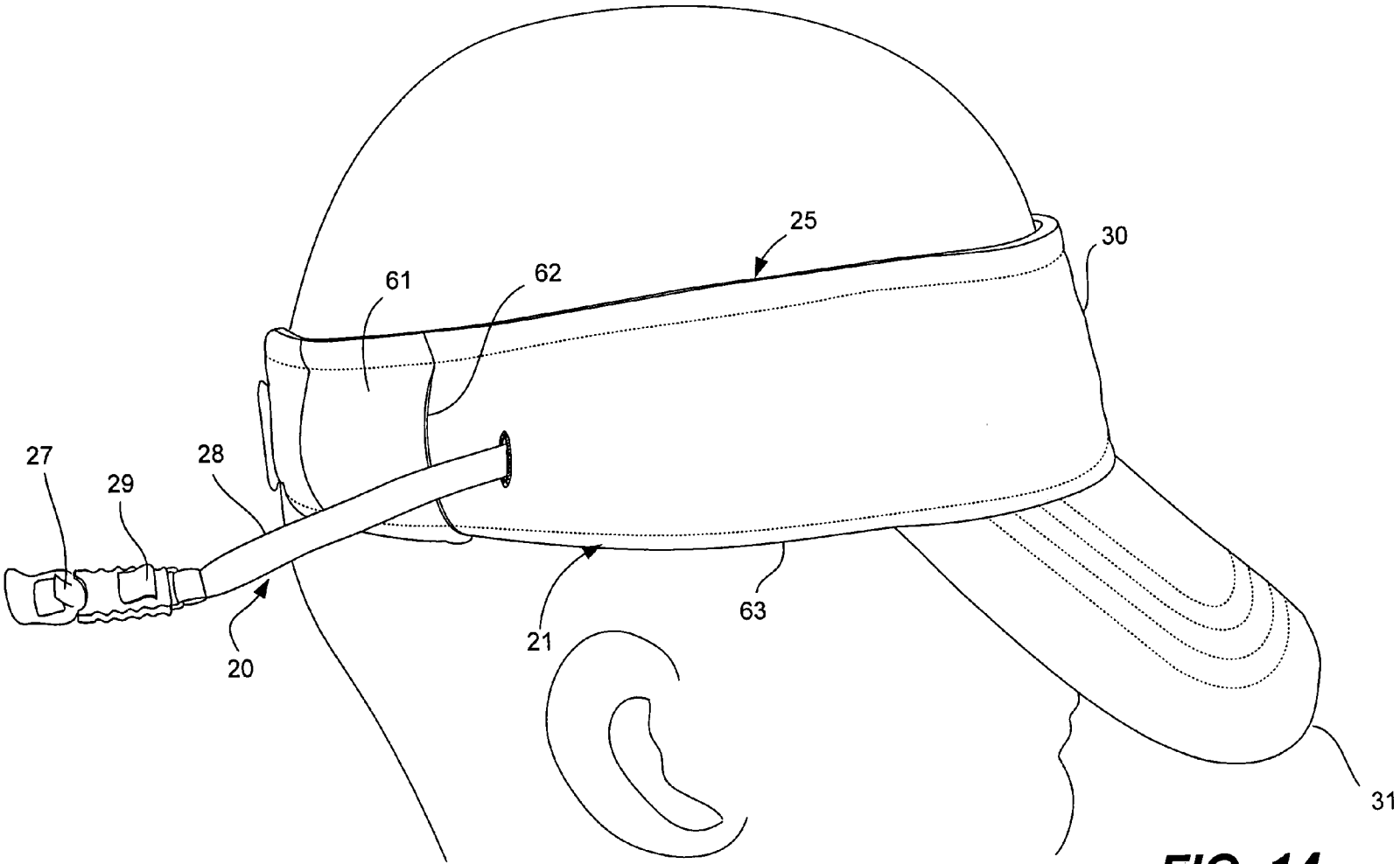
FIG. 14 is a side elevation view of the visor-style headwear of FIG. 13, illustrating the tether in an extended condition.
Figure 17:
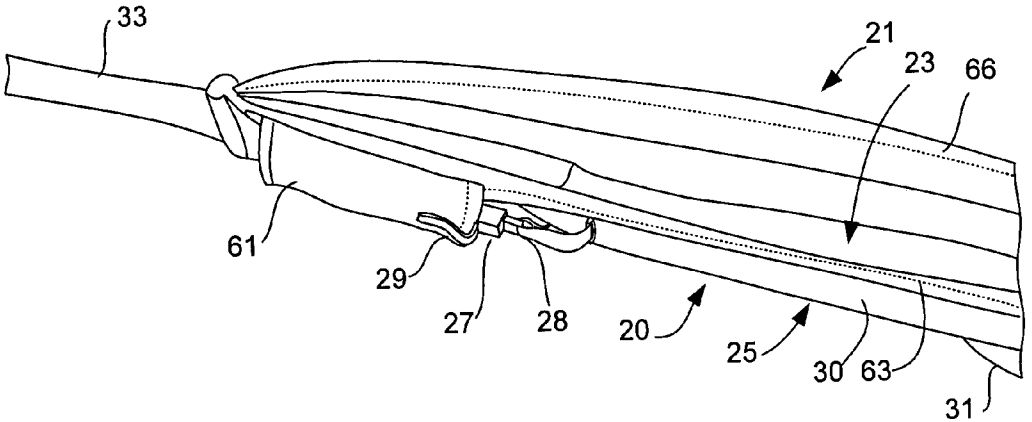
FIG. 17 is a top perspective view of one end of the visor-style headwear of FIG. 15, illustrating the protective headband nearly in the closed condition with the tether apparatus in the retracted condition, and the can opener secured in the parking receptacle.
Figure 18:
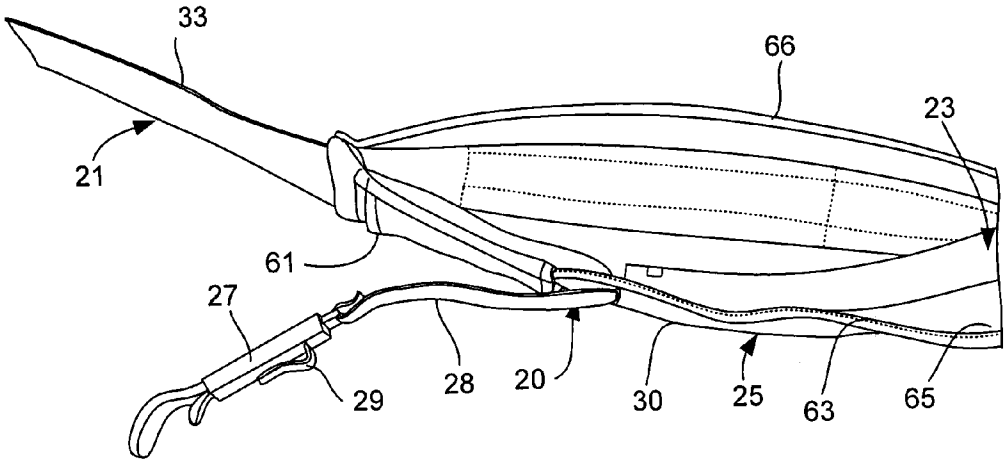
FIG. 18 is a top perspective view of the one end of the visor-style headwear of FIG. 17, illustrating the protective headband in the opened condition with the tether apparatus in the extended condition.
Figure 19:
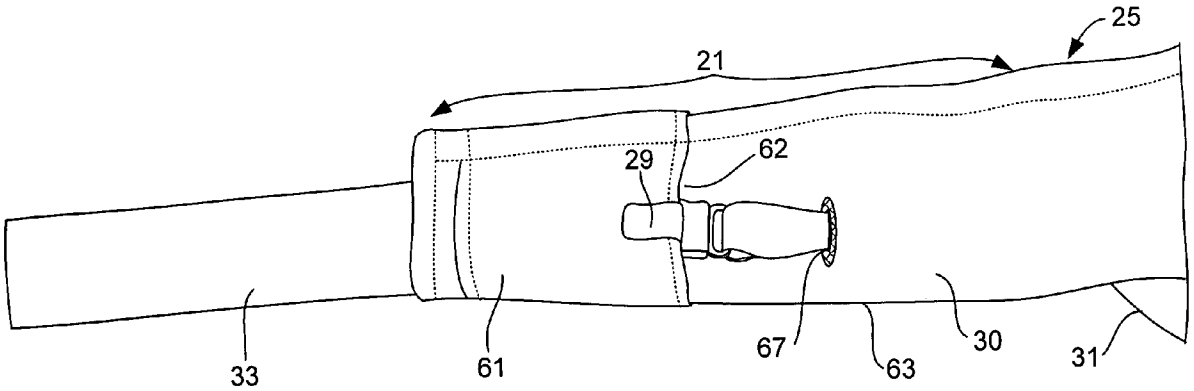
FIG. 19 is a side elevation view of one end of the visor-style headwear of FIG. 15, illustrating the tether apparatus in the retracted condition, and the can opener secured in the parking receptacle.
Figure 20:
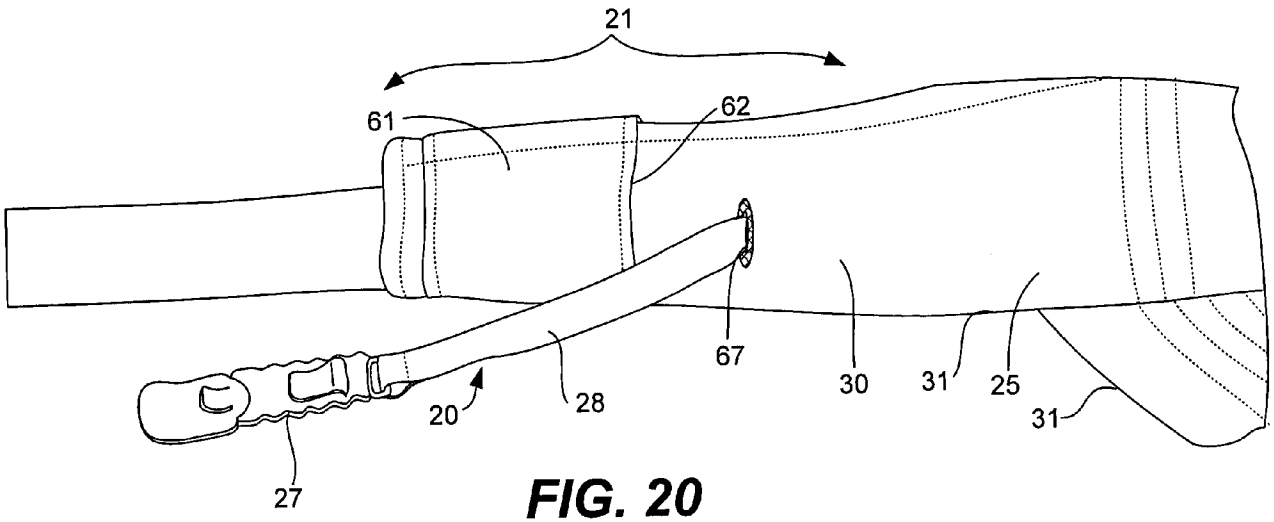
FIG. 20 is a side elevation view of the one end of the visor-style headwear of FIG. 19, illustrating the tether apparatus in extended condition.

In accordance with the present invention, the functional device 27 can be delivered, to enable freer operation, simply by pulling on the it or the tether 28. During periods of nonuse, the tether 28 can be retracted back into the pocket 41 through the access aperture 67 and the pocket opening 43. This is performed by manually manipulating the guide base 26, via pull tab 37, along the guide track 40 from the first position (FIGS. 14, 16 and 18) to the second position (FIGS. 13, 15 and 17). Consequently, the tether 28, which is attached to the guide base 26 at the one end is pulled and retracted back through the access aperture 67 and pocket opening 43, and along the fixed path of the pocket 41 toward the retracted condition.

The extension length of the tether 28 is likewise be controlled by the length of the fixed path from the first position to the second position. For instance, should the guide portion 23 of the mounting assembly only extend fully from one distal end of the crown portion 30 to an opposite distal end thereof, the extension length of the tether 28 from the retracted condition to the extended condition will be proportionately lengthened.

Although only a few embodiments of the present inventions have been described in detail, it should be understood that the present inventions may be embodied in many other specific forms without departing from the spirit or scope of the inventions.

What is claimed is:

1. A retractable tether apparatus for headwear comprising:

a guide base configured to movably mount to said headwear for movement thereof along a fixed path between a first position and a second position;

a functional device providing a function;

a covered parking structure cooperating with said headwear to form a covered parking receptacle formed and dimensioned for sliding receipt of the functional device therein in a manner substantially concealing the functional device under the parking structure when positioned therein; and a flexible tether having one portion thereof mounted to the functional device, and another portion thereof mounted to said guide base such when said guide base moves along the fixed path between said first position and said second position, said tether and said functional device move between a retracted condition, positioning said tether substantially along the fixed path and orienting said functional device proximate to said parking receptacle for sliding receipt therein during periods of nonuse, and an extended condition, positioning said tether at an exterior of said headwear to enable functional access to the functional device.

2. The tether apparatus according to claim 1, further including:

a guide portion configured to mount to a cap portion of said headwear along said fixed path, and adapted to cooperate with said guide base for guided movement thereof along the fixed path between the first position and the second position.

3. The tether apparatus according to claim 2, wherein said guide portion cooperates with said cap portion to form a pocket upon which a substantial portion of said tether retracts in said retracted condition, and when said guide base is moved to said first position.

4. The tether apparatus according to claim 3, wherein said guide portion and said guide base cooperate to form a zipper mechanism.

5. The tether apparatus according to claim 3, wherein said guide portion is affixed to a rear facing wall of the cap portion.

6. The tether apparatus according to claim 5, wherein said tether further extends through an access aperture in said cap portion.

7. The tether apparatus according to claim 1, wherein said functional device includes a clip member formed and dimension to cooperate with the parking structure to releasably lock the functional device in the parking receptacle when the tether is moved to the retracted position.

8. The tether apparatus according to claim 1, wherein said functional device comprises one of a bottle opener, a flashlight and a retaining device.

9. The tether apparatus according to claim 1, wherein said parking structure includes a flexible sheet material having opposed sides affixed to said headwear, forming said parking receptacle therebetween.

10. The tether apparatus according claim 9, wherein said functional device includes a clip member formed and dimension to cooperate with the sheet material to releasably lock the functional device thereto when said functional element is received in the parking receptacle.

11. A headwear assembly comprising:

a headwear device including a cap portion having an interior facing wall, and a bottom edge portion thereof configured to extend substantially equatorially around a forehead of a user when the headwear assembly is retained on the user's head;

a mounting assembly including an elongated guide portion disposed substantially adjacent to the cap portion interior wall, and extending generally in a direction longitudinally along the bottom edge portion of the cap portion, and a guide base movably cooperating with said guide portion for movement thereof along a fixed path in a direction generally longitudinally along the bottom edge portion between a first position and a second position;

a functional device providing a function; and an elongated flexible tether having one portion thereof mounted to the functional device, and another portion thereof mounted to said guide base such that when said guide base moves along the fixed path between said first position and said second position, said tether and said functional device move between a retracted condition and an extended condition, enabling freer operation of the functional device.

12. The headwear assembly according to claim 11, wherein said cap portion of the headwear device includes an elongated crown portion defining said bottom edge portion, and having the interior facing wall supporting the guide portion thereon.

13. The headwear assembly according to claim 12, wherein said guide portion cooperates with said interior facing wall to form an elongated pocket upon which a substantial portion of said tether retracts in said retracted condition, and when said guide base is moved to said first position.

14. The headwear assembly according to claim 12, wherein said headwear device defines a parking receptacle formed and dimensioned for sliding receipt of the functional device therein.

15. The headwear assembly according to claim 11, wherein said headwear device includes an elongated protective headband portion disposed substantially adjacent to the interior facing wall, and extending along at least a substantial portion of the bottom edge portion of the cap portion in a manner such that said mounting assembly is disposed between the interior facing wall and the protective headband portion when a user wears the headwear device.

16. The headwear assembly according to claim 15, wherein said headband portion is secured to the cap portion in a manner enabling movement of the headband portion, relative to the interior facing wall, between a closed condition, preventing access to the mounting assembly, and an opened condition, permitting access to the mounting assembly.

17. The headwear assembly according to claim 16, wherein said headband portion is secured to the cap portion substantially at the opposed, adjacent bottom edges thereof.

18. The headwear assembly according to claim 11, wherein said cap portion includes an access aperture for delivery of the tether from through the interior facing wall, from the retracted condition to the extended condition.

19. The headwear assembly according to claim 11, further including a covered parking structure that cooperates with the cap portion to define a parking receptacle formed and dimensioned for sliding receipt of the functional device therein in a manner substantially concealing the functional element under the parking structure when positioned therein.

20. The headwear assembly according to claim 19, wherein said parking structure includes a flexible sheet material having opposed sides affixed to said headwear, forming said parking receptacle therebetween.

21. The headwear assembly according to claim 20, wherein said functional device includes a clip member formed and dimension to cooperate with the sheet material to releasably lock the functional device thereto when the tether is moved to the retracted position.

22. The headwear assembly according to claim 20, wherein said parking structure is disposed substantially adjacent said access aperture.

23. The headwear assembly according to claim 11 wherein said headwear device is comprised of a visor-style headwear.

24. The headwear assembly according to claim 11, wherein said functional device comprises one of a bottle opener, a flashlight and a retaining device.

* * * * *